US005811045A

United States Patent [19]

Pike

[11] Patent Number: 5,811,045

[45] Date of Patent: Sep. 22, 1998

[54] PROCESS OF MAKING MULTICOMPONENT FIBERS CONTAINING A NUCLEATING AGENT

[75] Inventor: Richard Daniel Pike, Norcross, Ga.

[73] Assignee: Kimberly-Clark Worldwide, Inc., Neenah, Wis.

[21] Appl. No.: 806,159

[22] Filed: Feb. 25, 1997

Related U.S. Application Data

[62] Division of Ser. No. 522,479, Aug. 30, 1995.

[51] Int. Cl.[6] ..... D01F 8/04; D02G 1/00

[52] U.S. Cl. ..... 264/168; 264/172.14; 264/172.15; 264/210.5; 264/210.6; 264/211; 264/211.17

[58] Field of Search ..... 264/168, 172.14, 264/172.15, 210.5, 210.6, 211, 211.17

[56] References Cited

U.S. PATENT DOCUMENTS

| | | | |
|---|---|---|---|
| 3,135,646 | 6/1964 | Hayden | 428/371 |
| 3,207,739 | 9/1965 | Wales | 524/396 |
| 3,352,778 | 11/1967 | Sugg et al. | 252/325 |
| 3,423,266 | 1/1969 | Davies et al. | 156/167 |
| 3,595,731 | 7/1971 | Davies et al. | 428/151 |
| 3,725,192 | 4/1973 | Ando et al. | 428/373 |
| 3,802,817 | 4/1974 | Matsuki et al. | 425/66 |
| 4,115,620 | 9/1978 | Gupta et al. | 428/374 |
| 4,118,534 | 10/1978 | Stanley | 428/370 |
| 4,163,078 | 7/1979 | Reinehr et al. | 428/373 |
| 4,280,860 | 7/1981 | Shen et al. | 156/167 |
| 4,290,987 | 9/1981 | Soehngen et al. | 264/41 |
| 4,314,039 | 2/1982 | Kawai et al. | 525/1 |
| 4,469,540 | 9/1984 | Furukawa et al. | 156/62.4 |
| 4,473,617 | 9/1984 | van Leeuwen et al. | 428/373 |
| 4,521,484 | 6/1985 | Li | 428/374 |
| 4,547,420 | 10/1985 | Krueger et al. | 442/347 |
| 4,795,668 | 1/1989 | Krueger et al. | 428/174 |
| 5,039,748 | 8/1991 | Wakatsuki et al. | 525/216 |
| 5,068,141 | 11/1991 | Kubo et al. | 428/219 |
| 5,069,970 | 12/1991 | Largman et al. | 428/373 |
| 5,071,705 | 12/1991 | Tanaka et al. | 428/370 |
| 5,082,720 | 1/1992 | Hayes | 442/362 |
| 5,108,820 | 4/1992 | Kaneko et al. | 428/198 |
| 5,130,195 | 7/1992 | Sampanis et al. | 428/370 |
| 5,164,262 | 11/1992 | Kobayashi et al. | 428/373 |
| 5,366,786 | 11/1994 | Connor et al. | 428/171 |
| 5,382,400 | 1/1995 | Pike et al. | 264/168 |

FOREIGN PATENT DOCUMENTS

| | | |
|---|---|---|
| 0 569 860 | 11/1993 | European Pat. Off. . |
| 580764 | 9/1946 | United Kingdom . |
| 869301 | 5/1961 | United Kingdom . |
| 1075689 | 7/1967 | United Kingdom . |
| 1459597 | 12/1976 | United Kingdom . |

OTHER PUBLICATIONS

"Crystallization and Morphology of Nucleated Polymers", by Garg et al., ANTEC 1988, pp. 1021–1025.

"The Effect of Pigments on the Development of Structure and Properties of Polypropylene Filaments", by Y Lin et al., ANTEC 1991, pp. 1950–1954.

"Heterogeneous Nucleation of Crystallization of High Polymers from the melt. I. Substrate–Induced Morphologies" by A. Chatterjee et al., Journal of Polymer Science, vol. 13, 1975, pp. 2369–2383.

Abstract of Japan 61–155, 437 (Published Jul. 15, 1986).

*Primary Examiner*—Leo B. Tentoni

*Attorney, Agent, or Firm*—Douglas H. Tulley, Jr.; Michael U. Lee

[57] ABSTRACT

There is provided in accordance with the present invention a process for making a helically crimped conjugate fiber containing at least a first polymeric composition and a second polymeric composition. The first and second polymeric compositions respectively contain different thermoplastic polymers having different solidification periods. The degree of latent helical crimp is controlled by selective addition of a nucleating agent to at least one of the first and second polymeric compositions. Addition of the nucleating agent to the polymeric composition with a faster solidification period increases the latest crimp and addition of the nucleating agent to the polymeric composition with a slower solidification period decreases the latent crimp.

11 Claims, 1 Drawing Sheet

PROCESS OF MAKING MULTICOMPONENT FIBERS CONTAINING A NUCLEATING AGENT

This application is a continuation of application Ser. No. 08/522,479 entitled "CRIMPED CONJUGATE FIBERS CONTAINING A NUCLEATING AGENT" and filed in the U.S. patent and Trademark Office on Aug. 30, 1995. the entirety of this Application is hereby incorporated by reference.

BACKGROUND OF THE INVENTION

The present invention is related to crimped conjugate fibers and nonwoven fabrics produced therefrom.

Nonwoven fabrics are used in a variety of products such as sterilization wraps, medical drapes, disposable garments, diapers, protective covers, diapers and incontinence care products. Suitable nonwoven fabrics for such products need to provide desirable levels of softness, strength, durability, porosity, uniformity and other physical properties.

In an effort to improve desirable properties of nonwoven fabrics, multicomponent conjugate fiber nonwoven fabrics or webs have been developed. Methods for producing conjugate fiber nonwoven fabrics are disclosed, for example, in U.S. Pat. Nos. 3,423,266 to Davies et al.; 3,595,731 to Davies et al.; 5,108,820 to Kaneko et al. and 5,382,400 to Pike et al. A conjugate fiber nonwoven fabric is produced from polymeric fibers or filaments containing at least two polymeric component compositions that are arranged in substantially distinct sections across the cross-section along the length of the fibers or filaments. In general, useful properties, e.g., textural and functional properties, of such nonwoven fabrics can be improved by crimping the fibers of the nonwoven fabrics.

Crimped conjugate fibers can be produced by mechanically crimping fully formed conjugate fibers or, if the conjugate fibers have latent crimpability, by activating the latent crimpability. As is known in the art, such latent crimpability is imparted in conjugate fibers when the component polymers of the conjugate fibers are selected from different polymers having dissimilar shrinkage and/or crystallization properties, and such latent crimpability can be activated, for example, by a heat treatment that activates crimps, especially helically crimps, in the conjugate fibers.

Although, in general, imparting crimps in the fibers improves textural properties, e.g., softness and drapability, of a nonwoven fabric, the required level of crimps depends on each use of the nonwoven fabric. In addition, when conjugate fibers are overly crimped, the crimped fibers themselves tend to additionally form macro-crimps, forming randomly distributed clumped regions in the fibers. Such fiber clumps makes it highly difficult to produce a nonwoven fabric having a uniform fiber coverage and bulk. Consequently, it is important to have methods for controlling the level of crimps in conjugate fibers. In this regard, it is known that the level of crimps in the conjugate fibers can be controlled by producing conjugate fibers from different component polymers that have different shrinkage and/or crystallization properties, i.e., controlling the level of potential crimpability, and by varying the duration and temperature of the heat treatment, i.e., controlling the degree of crimp-activation. However, these known methods may not always be practical for different production set ups and when the component polymers of a conjugate fiber cannot be substituted with other polymers.

There remains a need for a production process that can be used to control the level of latent activatable crimps in conjugate fibers or filaments.

SUMMARY OF THE INVENTION

The present invention provides a helically crimped multicomponent conjugate fiber which has at least a first polymer composition and a second polymer composition. The first composition contains a first thermoplastic polymer, and the second composition contains a second thermoplastic polymer, wherein the first and second thermoplastic polymers have different solidification periods and at least one of the first and second compositions contains an effective amount of a nucleating agent. The term "solidification period" as used herein indicates the amount of time that a melt spun polymer composition that exits the fiber-forming spinneret takes to solidify in a given conjugate fiber production set up, more specifically quenching and drawing set up.

The invention additionally provides a method for controlling the degree of latent crimpability in a helically crimpable multicomponent conjugate fiber, wherein the conjugate fiber has at least a first composition and a second composition, the first composition containing a first thermoplastic polymer and the second composition containing a second thermoplastic polymer. The first thermoplastic polymer has a faster solidification period than the second thermoplastic polymer. In accordance with the present invention, the process contains the steps of providing a first composition and a second composition, adding an effective amount of a nucleating agent in one of the first and second compositions, and then melt spinning the compositions into a conjugate fiber, wherein the conjugate fiber has a crimpable configuration that arranges the compositions in substantially distinct sections across the cross-section and extends the compositions continuously along the length of the conjugate fiber. In accordance with the present method, the degree of latent crimpability is increased when the nucleating agent is added in the first composition and the degree of latent crimpability is decreased when the nucleating agent is added in the second composition. The term "crimpable configuration" as used herein indicates a cross-sectional configuration of a conjugate fiber that does not impose geometrical or configurational constraints in the fiber to prevent the formation of crimps when the latent crimpability is activated. For example, a concentric sheath-core configuration is not a crimpable configuration since the concentrical symmetry of the cross-sections of the component polymers does not readily allow the fibers from forming thermally activated crimps.

Additionally, the terms "web" and "fabric" are used interchangeably, unless otherwise indicated, and the terms "fibers" and "filaments" are used interchangeably, unless otherwise indicated, since a filament typically denotes a continuous fiber.

DETAILED DESCRIPTION OF THE INVENTION

Figure 1:
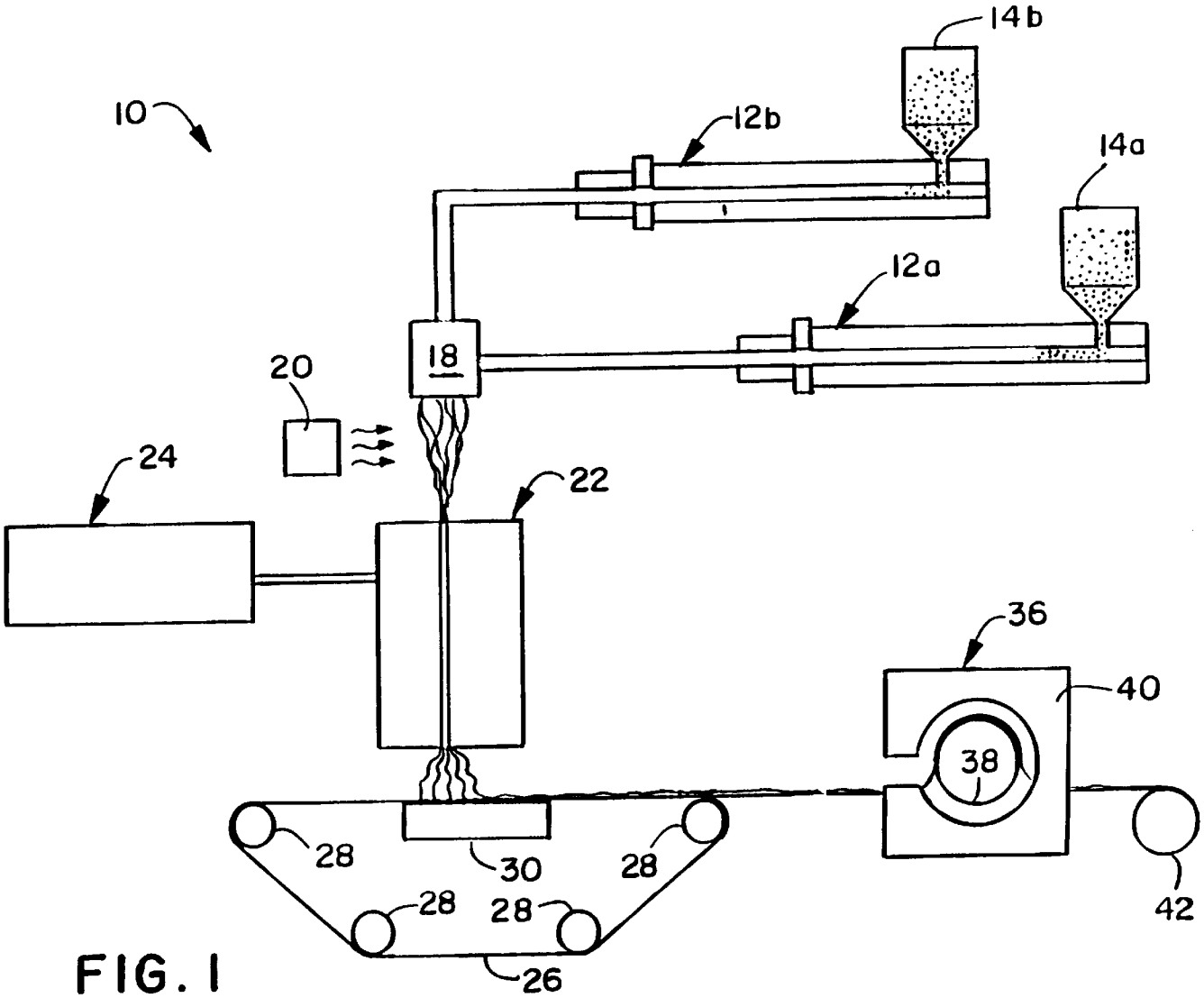
FIG. 1 illustrates a particularly suitable process for producing the conjugate fiber of the present invention.

The present invention provides a crimped conjugate fiber that contains a nucleating agent and a nonwoven fabric containing the conjugate fiber. The present invention additionally provides a method for controlling the level of crimps in conjugate fibers that have latent crimpability. Although the conjugate fibers of the present invention may contain more than two component compositions, the invention in general is described herein with two-component (bicomponent) conjugate fibers for illustration purposes.

Conjugate fibers of the present invention contain at least two component polymer compositions, and the conjugate fibers have a crimpable configuration. Suitable configurations include side-by-side configurations and eccentric sheath-core configurations. The component compositions of the conjugate fibers contain different polymers selected from semi-crystalline and crystalline thermoplastic polymers which have different solidification periods with respect to each other—a fast solidifying polymer and a slow solidifying polymer, comparatively. It is believed that the solidification period is influenced by different parameters including the melting temperature and the rate of crystallization of the component polymer. Accordingly, the fast solidifying component polymer of the conjugate fiber desirably has a melting point about 10° C. or higher, more desirably about 20° C. or higher, most desirably about 30° C. or higher, than the slow solidifying component polymer. However, the two component polymers may have similar melting points if their crystallization rates are measurably different.

Although it is not wished to be bound by any theory, it is believed that latent crimpability of conjugate fibers of semi-crystalline or crystalline polymers is created in the fibers due to the difference in shrinkage properties of the component polymers. One main cause of the shrinkage difference is believed to be the incomplete crystallization of the slow solidifying polymer during the conjugate fiber production process. When the fast solidifying polymer of the spun conjugate fiber exiting the spinneret is solidified, the partially solidified conjugate fiber does not measurably draw any longer and the slow solidifying polymer does not further experience significant orienting force. Consequently, the slow solidifying polymer, in the absence of orienting force, does not significantly further crystallize while being cooled and solidified. Accordingly produced conjugate fibers possess latent crimpability, and such latent crimpability can be activated by applying a heat treatment that allows sufficient molecular movement of the polymer molecules of the slow solidifying component polymer to facilitate further crystallization and shrinkage.

In accordance with the present invention, the level of crimps in the conjugate fibers, which have latent crimpability, is controlled by the addition of a nucleating agent. In general, a high degree of latent crimpability provides a high level of crimps when the fibers are exposed to a given latent crimpability activating temperature. Accordingly, the level of crimps in the conjugate fiber of the present invention can be controlled by regulating the degree of latent crimpability. In accordance with the invention, the level of crimps can be increased by adding an effective amount of a nucleating agent in the fast solidifying polymer component, and the level of crimps can be decreased by adding an effective amount of a nucleating agent in the slow solidifying polymer component. Desirably, between about 0.005% and about 2%, desirably between 0.01% and 1%, based on the total weight of the component composition of the conjugate fiber, of a nucleating agent is added in the polymer composition. Suitable nucleating agents for the present invention include organic and inorganic nucleating agents known to be suitable for crystalline and semi-crystalline thermoplastic polymers. Exemplary nucleating agents include sorbitol nucleating agents, e.g., dibenzylidene sorbitol, bis (p-methylenzylidene) sorbitol and bis (p-ethylbenzylidene) sorbitol; metal salts , e.g., sodium salt, of benzoic acid, dicarboxylic acid and arylalkanoic acid; sodium 2,2'-methylene bis(4,6-di-t-butylphenyl) phosphate; and mineral particles, e.g., fumed silica, fumed alumina and talc, having an average particle size less than about 1 μm, desirably less than about 0.5 μm and more desirably less than about 0.3 μm. Exemplary nucleating agents of metal salts of benzoic acid, dicarboxylic acid and arylalkanoic acid are disclosed in U.S. Pat. No. 3,207,739 to Wales, which patent in its entirety is herein incorporated by reference. Of these suitable nucleating agents, particularly suitable for the present invention are organic nucleating agents including sorbitol nucleating agents and sodium 2,2'-methylene bis(4,6-di-t-butylphenyl) phosphate.

Crystalline and semi-crystalline polymers suitable for the present invention include polyolefins, polyamides, polyesters, vinyl acetate-based polymers, and blends and copolymers thereof. Useful polyolefins include polyethylenes, e.g., high density polyethylene, medium density polyethylene, low density polyethylene and linear low density polyethylene; polypropylenes, e.g., isotactic polypropylene and syndiotactic polypropylene; polybutylenes, e.g., poly(1-butene) and poly(2-butene); polypentenes, e.g., poly(2-pentene), and poly(4-methyl-1-pentene); and blends thereof. Useful polyolefin copolymers include ethylene-propylene copolymers. Useful vinyl acetate-based polymers include polyvinyl acetate; ethylene-vinyl acetate; saponified polyvinyl acetate, i.e., polyvinyl alcohol; ethylene-vinyl alcohol and blends thereof. Useful polyamides include nylon 6, nylon 6/6, nylon 10, nylon 4/6, nylon 10/10, nylon 12, hydrophilic polyamide copolymers such as caprolactam and alkylene oxide diamine, e.g., ethylene oxide diamine, copolymers and hexamethylene adipamide and alkylene oxide copolymers, and blends thereof. Useful polyesters include polyethylene terephthalate, polybutylene terephthalate, and blends thereof. Of these, particularly suitable polymer combinations include polypropylene/polyethylene, e.g., isotactic polypropylene/high density polyethylene and isotactic polypropylene/linear low density polyethylene; nylon/polyproplene, e.g., nylon 6/isotactic polypropylene and nylon 6,6/isotactic polypropylene; nylon/polyethylene, e.g., nylon 6/high or linear low density polyethylene and nylon 6,6/high or linear low density polyethylene; polyester/propylene, e.g., polyethylene terephthalate/isotactic polypropylene and polybutylene terephthalate/isotactic polypropylene; polyester/polyethylene, e.g., polyethylene terephthalate/high or linear low density polyethylene and polybutylene terephthalate/high or linear low density polyethylene.

As stated above, the latent crimpability of the conjugate fibers is activated by a heat treatment. The heat treatment heats the fibers to a temperature equal to or higher than the temperature at which the slow solidifying component polymer starts to resume its crystallization but below the melting point of the lowest melting component polymer. Depending on the polymers selected for the conjugate fibers, the heat treatment temperature will vary widely. However, the heat treatment in general needs to raise the temperature of the fibers to about 45° C. or higher in order to appreciably activate the latent crimp. In general, a higher temperature induces a higher number of crimps in the fiber. The latent crimps can be activated before, during or after the fibers are deposited or laid to form a nonwoven web. However, it is highly desirable to activate the crimps in the fibers before they are deposited to form a nonwoven web since the crimping process inherently causes shrinkage and dimensional changes that are difficult to manage and tend to adversely affect uniformity and fiber coverage of the web. Therefore, it is highly advantageous to crimp the conjugate fibers before they are formed into a nonwoven web in order to provide a dimensionally stable web that has uniform fiber coverage and uniform bulk.

The conjugate fibers of the present invention can be produced by various known processes for producing conjugate fibers, including staple fiber production processes, spunbond fiber production processes, flash spinning processes and meltblown fiber production process. Of these, particularly suitable processes for the present invention are spunbond fiber production processes.

A particularly suitable process for the present invention that produces crimped spunbond conjugate fibers and a nonwoven fabric containing the fibers is disclosed in U.S. Pat. No. 5,382,400 to Pike et al. The patent in its entirety is herein incorporated by reference. Turning to FIG. 1, there is illustrated an exemplary conjugate fiber spunbond nonwoven fabric production process 10 that is particularly suitable for the present invention. A pair of extruders 12*a* and 12*b* separately extrude the component compositions for the conjugate fibers, in which at least one of the compositions contains an effective amount of a nucleating agent. The compositions are separately fed into a first hopper 14*a* and a second hopper 14*b,* to simultaneously supply molten polymeric compositions to a spinneret 18. Suitable spinnerets for extruding conjugate fibers are well known in the art. Briefly, the spinneret 18 has a housing which contains a spin pack, and the spin pack contains a plurality of plates and dies. The plates have a pattern of openings arranged to create flow paths for directing the two polymers to the dies that have one or more rows of openings, which are designed in accordance with the desired configuration of the resulting conjugate fibers.

The spinneret 18 provides a curtain of conjugate filaments or continuous fibers, and the continuous fibers are quenched by a quench air blower 20 and develop latent crimpability. The quenched fibers are then fed to a fiber drawing unit. Any pneumatic fiber drawing unit or aspirator that is known to be suitable for a spunbond process can be used for the present invention provided that the fiber draw unit is modified to utilize heated air, instead of conventionally used ambient air, to draw the fibers. Of these, particularly suitable fiber draw units for the present invention are linear fiber aspirators of the type disclosed in U.S. Pat. No. 3,802,817 to Matsuki et al., which in its entirety is incorporated by reference. Briefly, the fiber draw unit 22 includes an elongate vertical passage through which the filaments are drawn by fiber drawing air entering from the side of the passage. The drawing air, which is supplied from a compressed air source 24, draws the filaments and imparts molecular orientation in the filaments. In accordance with the present invention, the drawing air is heated with a temperature adjustable heater in order to simultaneously draw the fibers and activate the latent crimpability. The temperature of the drawing air can be varied to achieve different levels of crimps, as indicated above. In accordance with the present invention, the solidifying periods of the component polymers are determined in this fiber quenching and drawing environment.

The process line 10 further includes an endless foraminous forming surface 26 which is placed below the draw unit 22 and is driven by driver rollers 28 and positioned below the fiber draw unit 22. The drawn filaments exiting the fiber draw unit are generally deposited in isotropical or random fashion onto the forming surface 26 to form a nonwoven web of uniform thickness and fiber coverage. The fiber depositing process can be better facilitated by placing a vacuum apparatus 30 directly below the forming surface 26 where the fibers are being deposited. The above-described simultaneous drawing and crimping process is highly useful for producing lofty spunbond webs that have uniform fiber coverage and uniform web caliper.

The deposited nonwoven web is then bonded, for example, with a through air bonding process. Generally described, a through air bonder 36 includes a perforated roller 38, which receives the web, and a hood 40 surrounding the perforated roller. Heated air, which is hot enough to melt the lower melting component polymer of the conjugate fiber, is supplied by the hood 40 to the web through the perforated roller 38. The heated air melts the lower melting polymer and the melted polymer forms interfiber bonds throughout the web, especially at the cross-over contact points of the fibers. Through air bonding processes are particularly suitable for producing a lofty, uniformly bonded spunbond web since these processes uniformly effect interfiber bonds without applying significant compacting pressure. Alternatively, the unbonded nonwoven web can be bonded with a calender bonding process. A calender bonding process typically utilizes an assembly of two or more of abuttingly placed heated rolls that form a nip to apply a combination of heat and pressure to melt fuse the fibers of a web to form bonded regions or points in the web. The bonding rolls may be smooth or contain a pattern of raised bond points.

Although the present invention is largely illustrated heretofore by providing a nucleating agent in one component composition of the conjugate fiber to either increase or decrease the level of crimps, the crimp level of the conjugate fiber can also be controlled even when all component compositions of the conjugate fiber contain a nucleating agent. The crimp increasing and decreasing effect of a nucleating agent can be accomplished by adding disparate amounts of the nucleating agent in the component compositions. In addition, if component polymers are selected from polymers having different crystallization kinetic responses to a nucleating agent, both component polymer compositions of a conjugate fiber may contain an equal amount of a nucleating agent and yet provides improved crimpability. An exemplary pair of such polymer combination is polypropylene and polyethylene, more particularly, polypropylene and linear low density polyethylene.

As indicated above, the conjugate fibers of the present invention can be controlled to have varying levels of crimps, and thus, the bulk of the nonwoven fabrics containing the conjugate fibers can be adjusted to desirable levels. For example, when a combination of selected component polymers provides an undesirably low level of crimps, a nucleating agent can be added to the fast solidifying composition to increase the crimp level, and if a combination of selected component polymers provides an overly high level of crimps, a nucleating agent can be added to the slow solidifying composition to decrease the crimp level.

In addition to the nucleating agent, the polymer compositions of the conjugate fibers may contain minor amounts of various additives and fillers that are conventionally used in the production of fibers and nonwoven fabrics. Useful additives include compatibilizing agents, colorants, optical brighteners, ultraviolet light stabilizers, antistatic agents, lubricants, abrasion resistance enhancing agents and other processing aids.

The nonwoven fabric or web of the present invention that contains conjugate fibers having a controlled level of crimps can be used in a wide variety of products. Nonwoven fabrics of the present invention that have a high level of crimps and thus have a high bulk and a high porosity are, for example, highly suitable for fluid management layers of absorbent and personal care articles, e.g., diapers, incontinence care articles, sanitary napkins and training pants; active agent delivery system, e.g., cosmetic scrubbing pads and polishing agent applying pads; and filters. Present nonwoven fabrics that have a low level of crimps and thus a low bulk are, for example, highly suitable for protective garments, drapes, wraps and cloth-like outer cover materials for absorbent and personal care articles.

The following examples are provided for illustration purposes and the invention is not limited thereto.

EXAMPLES

Example 1 (Ex1)

A 1.5 ounce per square yard (51 g/m$^2$) spunbond bicomponent fiber web was produced in accordance with aforementioned U.S. Pat. No. 5,382,400. A linear low density polyethylene (LLDPE), Aspun 6811A, which is available from Dow Chemical, was blended with 2 wt % of a $TiO_2$ concentrate which had 50 wt % of $TiO_2$ and 50 wt % of a polypropylene, and the mixture was fed into a first single screw extruder. A polypropylene, PD3445, which is available from Exxon, was blended with 2 wt % of the above-described $TiO_2$ concentrate and with an effective amount of an organic nucleating agent, Ashai Chemical's NA-11, to achieve 2,000 ppm. NA-11 is sodium 2,2'-methylene bis(4, 6-di-t-butylphenyl) phosphate. The mixture was fed into a second single screw extruder. In this component polymer combination, polypropylene is the fast solidifying polymer and LLDPE is the slow solidifying polymer. The extruded polymers were spun into round bicomponent fibers having a side-by-side configuration and a 1:1 weight ratio of the two component polymers using a bicomponent spinning die, which had a 0.6 mm spinhole diameter and a 6:1 L/D ratio. The melt temperatures of the polymers fed into the spinning die were kept at 450° F. (232° C.), and the spinhole throughput rate was 0.5 gram/hole/minute. The bicomponent fibers exiting the spinning die were quenched by a flow of air at 45 ft$^3$/min/inch (0.5 m$^3$/min/cm) and a temperature of 18° C. The quenching air was applied about 13 cm below the spinneret, and the quenched fibers were drawn in a fiber drawing unit of the type which is described in U.S. Pat. No. 3,802,817 to Matsuki et al. The aspirator was equipped with a temperature controlled fiber drawing air source, and the feed air temperature was kept at about 350° F. (177° C.). The quenched fibers were drawn with the heated feed air to attain a fiber size of about 2.7 denier (3 dtex). Then, the drawn fibers were deposited onto a foraminous forming surface with the assist of a vacuum flow to form an unbonded fiber web. The unbonded fiber webs were bonded by passing the web through a through-air bonder equipped with a heated air source. The heated air velocity and the temperature of the heated air was 200 feet/minute (61 m/min) and 272° F. (133° F.), respectively. The residence time of the web in the hood was about 1 second.

Based on the fact that the bulk of a nonwoven fabric, in general, correspondingly increases with the increasing level of crimps in the fibers that forms the nonwoven fabric, the bulk of resulting web was measured and compared to study the crimp inducing effect of utilizing a nucleating agent. The bulk of the resulting web was measured using a Starret-type bulk tester under 0.5 psi (3.4 pKa). The result is shown in Table 1.

Comparative Example 1 (C1)

Example 1 was repeated except the nucleating agent was not added in the component polymers of the fibers. The result is shown in Table 1.

Example 2 (Ex2)

This example was conducted to show the effect of reducing the temperature in activating the latent crimpability of the conjugate fiber and to show the efficacy of adding a nucleating agent to increase the crimp level in this low temperature condition. Example 1 was repeated except the drawing air temperature of the fiber drawing unit was reduced to 300° F. (149° C.).

Comparative Example 2 (C2)

Example 2 was repeated except the nucleating agent was not added.

TABLE 1

| Example | Bulk (inch) | Bulk (mm) |
|---|---|---|
| Ex 1 | 0.090 | 2.3 |
| C1 | 0.080 | 2.0 |
| Ex 2 | 0.073 | 1.8 |
| C2 | 0.058 | 1.5 |

The above results, which show that the bulk of the web of Example 1 was about 13% thicker than that of the web of Comparative Example 1, clearly demonstrate that adding a nucleating agent in the fast solidifying component polymer composition significantly enhances the degree of latent crimpability and thus improves the crimp level of the crimped conjugate fiber.

As discussed above and as can be seen from comparing the bulk data of Examples 1 and 2, the activating temperature applied on the conjugate fibers influences the level of crimps in the crimp activated conjugate fibers. The higher activating temperature of Example 1 produced a higher level of crimps in the fibers and thus a loftier nonwoven web. In addition, Example 2 and Comparative Example 2 demonstrate that even when a low temperature is applied to activate the latent crimpability, the nucleating agent improves the crimpability of the conjugate fibers. This is an important finding in that the present invention provides a highly crimpable conjugate fiber that does not require a high temperature to activate its latent crimpability. As is known in the art, it is highly advantageous to utilize a low processing temperature, specifically a low latent crimp activating temperature, and yet provide a high level of crimps in the fibers. This is because, for example, it is highly efficient and economical to utilize a low temperature latent crimp inducing medium since the energy requirement to raise the temperature of the medium is low and the energy requirement to cool the heated fibers is correspondingly low.

Example 3

Example 3 is provided to illustrate the utility of adding a nucleating agent in another combination of component polymers for the conjugate fibers. It is believed that when Example 1 is repeated except nylon 6 or polyethylene terephthalate is utilized in place of polypropylene, the resulting conjugate fibers will have a higher level of crimps than the conjugate fibers of the same compositions without the nucleating agent.

Example 4

Example 4 is provided to illustrate the utility of adding a nucleating agent in the slow solidifying component composition to reduce the level of crimps in the conjugate fibers. It is believed that when Example 1 is repeated except the nucleating agent is added to the LLDPE composition and not to the polypropylene composition, the crimp level of the resulting fibers will be lower than the conjugate fibers of Comparative Example 1.

Example 5

Example 5 is provided to illustrate the utility of adding a nucleating agent in both component compositions of the conjugate fibers. It is believed that when Example 1 is repeated except the same amount of the nucleating agent is added to both of the LLDPE and polypropylene compositions, the crimp level of the resulting fibers will be higher than the conjugate fibers of Comparative Example 1. It is believe that the nucleating agent has a higher nucleating impact on polypropylene than LLDPE, thereby promoting a high level of crimps in the conjugate fibers.

The crimpable conjugate fibers of the present invention can be produced to exhibit different levels of crimps. The conjugate fibers can be produced to have a controlled level of crimps and, thus, can be used to produce nonwoven fabrics having different levels of bulk, porosity and textural properties.

What is claimed is:

1. A process for controlling the level of latent crimpability in a helically crimpable multicomponent conjugate fiber, said conjugate fiber comprising at least a first composition and a second composition, said first composition comprising a first thermoplastic polymer and said second composition comprising a second thermoplastic polymer, said first thermoplastic polymer having a faster solidification period than said second thermoplastic polymer, wherein the process comprises:

a) adding an effective amount of a nucleating agent in one of said first and second compositions, said effective amount being selected to form a crimpable multicomponent conjugate fiber having a desired crimp level, b) melt spinning a conjugate fiber, said conjugate fiber having a crimpable configuration that arranges said compositions in substantially distinct sections across the cross-section and extends said compositions continuously along the length of said conjugate fiber, wherein said effective amount of nucleating agent increases the level of crimpability when said nucleating agent is added in said first composition and decreases the level of crimpability when said nucleating agent is added in said second composition.

2. The process of claim 1 wherein said first and second thermoplastic polymers are selected from the group consisting of polyolefins, polyamides, polyesters, vinyl acetate-based polymers, and blends and copolymers thereof.

3. The process of claim 2 wherein said nucleating agent is selected from the group consisting of sorbitol nucleating agents; metal salts of benzoic acid, dicarboxylic acid and arylalkanoic acid; sodium 2,2'-methylene bis(4,6-di-t-butylphenyl) phosphate; and mineral particles.

4. The process of claim 1 wherein said nucleating agent is added in an amount of at least about 0.005% and less than about 0.2%, based on the total weight of said first or second composition.

5. The process of claim 4 wherein said latent crimpability is activated by a heat treatment.

6. A process for controlling the level of latent crimp in multicomponent fibers, comprising:

providing a first thermoplastic polymer and a second thermoplastic polymer wherein said first thermoplastic polymer has a faster solidification period and a melting point at least about 10° C. higher than said second thermoplastic polymer;

adding between 0.005 and 2% by weight of a nucleating agent to said first thermoplastic polymer wherein said nucleating agent increases the latent crimp of a crimpable multicomponent fiber;

melt spinning a multicomponent fiber from said first and second thermoplastic polymers wherein said multicomponent fiber has a crimpable cross-sectional configuration;

drawing said fibers; and heating said fibers wherein said multicomponent fibers crimp a desired degree.

7. The process of claim 6 wherein nucleating agent is added to both said first and second thermoplastic polymers and wherein said first thermoplastic polymer contains a higher weight percent of nucleating agent than said second thermoplastic polymer.

8. The process of claim 6 wherein said first thermoplastic polymer comprises polypropylene and said second thermoplastic polymer comprises polyethylene.

9. A process for controlling the level of latent crimp in multicomponent fibers, comprising:

providing a first thermoplastic polymer and a second thermoplastic polymer wherein said first thermoplastic polymer has a faster solidification period and a melting point at least about 10° C. higher than said second thermoplastic polymer;

adding between 0.005 and 2% by weight of a nucleating agent to said second thermoplastic polymer wherein said nucleating agent decreases the latent crimp of a crimpable multicomponent fiber;

melt spinning a multicomponent fiber from said first and second thermoplastic polymers wherein said multicomponent fiber has a crimpable cross-sectional configuration;

drawing said fibers; and heating said fibers wherein said multicomponent fibers crimp a desired degree.

10. The process of claim 9 wherein nucleating agent is added to both said first and second thermoplastic polymers and wherein said first thermoplastic polymer contains a higher weight percent of nucleating agent than said second thermoplastic polymer.

11. The process of claim 9 wherein said first thermoplastic polymer comprises polypropylene and said second thermoplastic polymer comprises polyethylene.

* * * * *